US011230859B2

(12) United States Patent
Petersen

(10) Patent No.: US 11,230,859 B2
(45) Date of Patent: Jan. 25, 2022

(54) MAGNETIC KEYED LOCK

(71) Applicant: Daniel Petersen, Albuquerque, NM (US)

(72) Inventor: Daniel Petersen, Albuquerque, NM (US)

( * ) Notice: Subject to any disclaimer, the term of this patent is extended or adjusted under 35 U.S.C. 154(b) by 318 days.

(21) Appl. No.: 16/504,087

(22) Filed: Jul. 5, 2019

(65) Prior Publication Data

US 2021/0002923 A1 Jan. 7, 2021

(51) Int. Cl.
*E05B 47/00* (2006.01)

(52) U.S. Cl.
CPC ..... *E05B 47/0044* (2013.01)

(58) Field of Classification Search
CPC ..... E05B 47/00; E05B 47/0044
USPC ..... 70/413, 344, 408, 456 R, 402–404, 406
See application file for complete search history.

(56) References Cited

U.S. PATENT DOCUMENTS 2,671,369 A * 3/1954 Clark ..... B25B 23/12 81/125
3,111,834 A * 11/1963 Felson ..... E05B 47/0044 70/276
3,416,336 A * 12/1968 Felson ..... E05B 47/0044 70/276
3,512,382 A * 5/1970 Mauro ..... E05B 47/0044 70/276
3,533,314 A * 10/1970 Ostrager ..... B25B 33/005 81/436
3,552,159 A * 1/1971 Craig ..... E05B 47/0038 70/276
3,566,637 A * 3/1971 Hallmann ..... E05B 47/0044 70/276
3,633,393 A * 1/1972 Hisatsune ..... E05B 47/0042 70/276
3,654,782 A * 4/1972 Heimann ..... E05B 47/0042 70/276
3,656,328 A * 4/1972 Hughes ..... E05B 19/0023 70/276
3,657,907 A * 4/1972 Boving ..... E05B 47/0041 70/38 C
3,665,740 A * 5/1972 Taniyama ..... E05B 47/0044 70/276

(Continued)

FOREIGN PATENT DOCUMENTS

DE 2353407 * 9/1975 ..... E05B 47/00
GB 1484249 A * 9/1977 ..... E05B 47/0044

*Primary Examiner* — Suzanne L Barrett
(74) *Attorney, Agent, or Firm* — Kunzler Bean & Adamson, PC

(57) ABSTRACT

Apparatuses, systems, and methods are disclosed for magnetic keyed locking. A cylinder is disposed in a housing. The cylinder is formed with an end opening and a plurality of side openings. The end opening communicates with an interior recess. A plurality of rotors are disposed in the side openings and pivotably coupled to the cylinder. The rotors include inner portions that extend from pivot points toward the interior recess, and outer portions that extend from the pivot points past an outer surface of the cylinder. One or more blocking bars are affixed to the housing. The one or more blocking bars are formed with a plurality of slots, and are disposed such that rotation of the cylinder is permitted when the rotors are aligned with the slots and limited when at least one rotor is non-aligned with a slot.

20 Claims, 7 Drawing Sheets

(56) References Cited

U.S. PATENT DOCUMENTS

| | | | | | |
|---|---|---|---|---|---|
| 3,935,720 | A * | 2/1976 | Boving | E05B 47/0042 | 70/276 |
| 4,084,416 | A | 4/1978 | Prunbauer | | |
| 4,228,667 | A * | 10/1980 | Herriott | E05B 47/0044 | 70/276 |
| 4,253,320 | A | 3/1981 | Schwab et al. | | |
| 4,285,220 | A * | 8/1981 | Kajita | E05B 47/0041 | 70/276 |
| 4,287,733 | A * | 9/1981 | Gomez-Olea | G07C 9/00738 | 70/276 |
| 4,380,162 | A * | 4/1983 | Woolfson | E05B 47/0044 | 70/276 |
| 4,686,841 | A | 8/1987 | Prunbauer et al. | | |
| 4,841,758 | A * | 6/1989 | Ramblier | E05B 47/0044 | 70/276 |
| 5,839,307 | A * | 11/1998 | Field | E05B 47/063 | 70/283 |
| 6,705,139 | B2 | 3/2004 | Tsai | | |
| 2018/0298643 | A1 * | 10/2018 | Con | E05B 19/0052 | |

* cited by examiner

MAGNETIC KEYED LOCK

FIELD

This invention relates to locks and more particularly relates to a magnetic keyed lock.

BACKGROUND

Various types of lock and key systems are used to prevent unauthorized access to property such as buildings, rooms, vehicles, personal possessions, land, and the like. Some locks rely on a mechanical interface between a key and tumblers, which may be pins wafers, levers, disks, or the like. When the correct key is inserted into the lock, the key moves the tumblers into a position that permits the key to be turned to move a latch or bolt, open a shackle, or the like. When an incorrect key is inserted, the tumblers are moved into a position that does not permit the key to be turned. Similarly, if a key is not inserted, the tumblers are positioned to prevent motion of the portion of the lock that would be moved by turning the correct key. Thus, an authorized person with the correct key may use the key to access the property secured by the lock, but an unauthorized person without a correct key is prevented from accessing the property secured by the lock However, in a lock where tumblers are mechanically moved by a key, an unauthorized person may be able to use a lock pick, by raking the pins or bumping the lock while the key cylinder is being torqued, or the like, to manipulate the pins or tumblers into a position that allows the lock to be opened. Picking a lock by mechanically manipulating tumblers or other components of the lock may allow a person without the correct key to access the property secured by the lock.

SUMMARY

Apparatuses are presented for magnetic keyed locking. In one embodiment, a cylinder is disposed in a housing. In certain embodiments, the cylinder is formed with an end opening and a plurality of side openings. In further embodiments, the end opening communicates with an interior recess. In one embodiment, a plurality of rotors are disposed in the side openings and pivotably coupled to the cylinder. In a further embodiment, the rotors include inner portions that extend from pivot points toward the interior recess, and outer portions that extend from the pivot points past an outer surface of the cylinder. In one embodiment, one or more blocking bars are affixed to the housing. In certain embodiments, the one or more blocking bars are formed with a plurality of slots. In further embodiments, the one or more blocking bars are disposed such that rotation of the cylinder is permitted when the rotors are aligned with the slots and limited when at least one rotor is non-aligned with a slot.

In one embodiment, the one or more blocking bars are formed with a plurality of blind openings shaped to arrest the motion of rotors that are non-aligned with slots such that a rotor that engages a blind opening is prevented from aligning with a slot. In a further embodiment, the one or more blocking bars are disposed such that the plurality of rotors simultaneously engage the one or more blocking bars. In one embodiment, the one or more blocking bars include one slot per rotor and at least one blind opening per rotor. In certain embodiments, the outer portions of the rotors are chamfered to guide the rotors into the slots or the blind openings.

In one embodiment, the side openings of the cylinder do not communicate with the interior recess. In certain embodiments, the rotors are disposed along and around the cylinder. In one embodiment, the plurality of rotors includes eight to sixteen rotors. In certain embodiments, at least the inner portions of the rotors include a magnetic material. In one embodiment, the rotors do not include magnets. In certain embodiments, the cylinder includes a non-magnetic, non-galling material.

In one embodiment, a key is shaped to be inserted through the end opening into the interior recess of the cylinder. In certain embodiments, a key includes a non-magnetic shaft. In further embodiments, a key includes a plurality of magnets positioned in the shaft based on positions of the slots in the one or more blocking bars, such that when the key is inserted into the cylinder, the inner portions of the rotors align to magnet positions, resulting in the outer portions of the rotors aligning to the slots.

In a further embodiment, the shaft of the key and the interior recess of the cylinder are cylindrical, and the magnets are disposed around and along the shaft. In one embodiment, the shaft includes groups of recesses at positions in the shaft corresponding to rotor positions. In a further embodiment, the magnets are secured in the groups of recesses with bonding material such that a group of recesses includes one recess holding a magnet and other recesses filled with the bonding material. In some embodiments, a group of recesses includes three recesses corresponding to three possible positions of slots in the one or more blocking bars.

In one embodiment, the key includes a non-magnetic sleeve surrounding the shaft. In a further embodiment, the key includes a key handle coupled to the shaft. In certain embodiments, the key handle is formed with an opening permitting the sleeve to retract into the opening when the key is in use. In certain embodiments, the key includes a compression spring disposed in the opening of the key handle to bias the sleeve into a position covering the magnets when the key is not in use. In one embodiment, the key includes a shear pin extending from the shaft. In a further embodiment, the shear pin is shaped to engage a slot in the end opening of the cylinder for transferring torque from the key to the cylinder. In certain embodiments, the shear pin is weaker than the cylinder, the rotors, and the one or more blocking bars.

An apparatus, in another embodiment, includes a key with a non-magnetic shaft. In a further embodiment, a plurality of magnets are positioned in the shaft based on positions of slots in one or more blocking bars of a lock, such that inserting the key into the lock aligns rotors to the slots.

In one embodiment, the shaft is cylindrical. In a further embodiment, the magnets are disposed around and along the shaft. In certain embodiments, a shear pin extends from the shaft for transferring torque from the key to the lock.

Methods are presented for magnetic keyed locking. A method, in one embodiment, includes providing a cylinder disposed in a housing. In certain embodiments, the cylinder is formed with an end opening and a plurality of side openings. In further embodiments, the end opening communicates with an interior recess. In certain embodiments, a method includes providing a plurality of rotors disposed in the side openings and pivotably coupled to the cylinder. In further embodiments, the rotors include inner portions that extend from pivot points toward the interior recess, and outer portions that extend from the pivot points past an outer surface of the cylinder. In one embodiment, a method includes forming a plurality of slots and a plurality of blind openings in one or more blocking bars. In a further embodiment, a method includes affixing the blocking bars to the housing such that rotation of the cylinder is permitted when the rotors are aligned with the slots and limited when at least one rotor is non-aligned with a slot. In one embodiment, a method includes providing a key with a shaft shaped to be inserted into the interior recess. In certain embodiments, a method includes disposing magnets at positions in the shaft based on positions of the slots in the one or more blocking bars, such that when the key is inserted into the cylinder, the inner portions of the rotors align to magnet positions, resulting in the outer portions of the rotors aligning to the slots.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
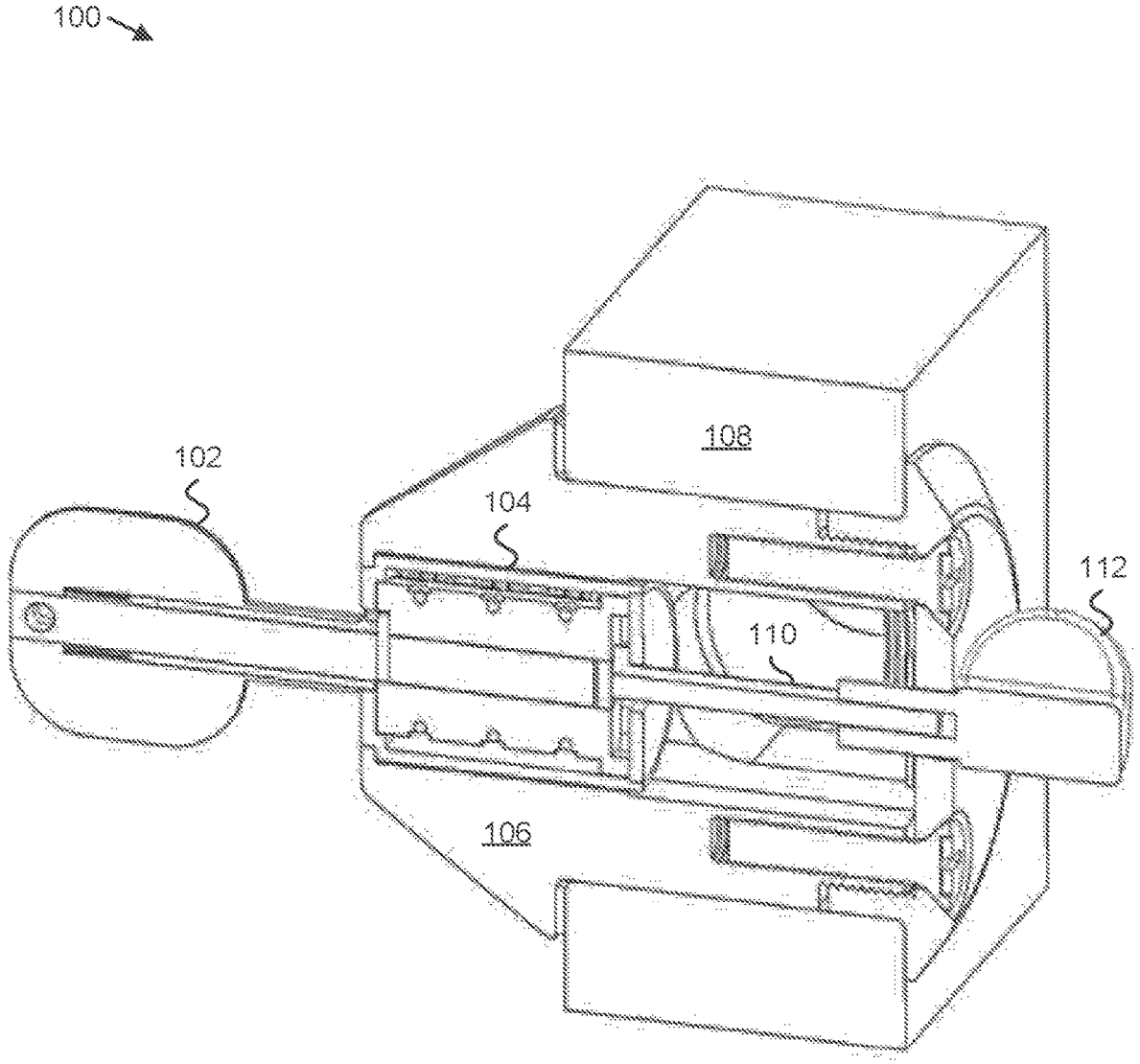
FIG. 1 is a cutaway perspective view illustrating one embodiment of a lock and key system.

FIG. 1 depicts one embodiment of a lock and key system 100, in a cutaway view. In the depicted embodiment, the lock and key system 100 includes a key 102 and a lock 104. In the depicted embodiment, the lock 104 is disposed in a lock casing 106, installed in a door 108. In one embodiment, the lock casing 106 houses a single cylinder lock with a twist knob 112. Turning the key 102 in the lock 104 turns a lock cylinder within a housing (as described in subsequent figures). As the lock cylinder turns, it rotates a tailpiece 110 to extend or retract a dead bolt (not shown), thus locking or unlocking the door 108. With the key 102 removed from the lock 104, or if an incorrect key is inserted into the lock 104, the lock cylinder is prevented from rotating within the housing, and the door 108 cannot be locked or unlocked from the side with the lock 104. However, the tailpiece 110 is coupled to the lock 104 in such a way that the tailpiece 110 can be rotated by the twist knob 112 to retract or extend the deadbolt without the lock cylinder rotating. Thus, the door 108 may still be locked or unlocked from the side with the twist knob 112.

In the depicted embodiment, the lock 104 is disposed in a lock casing 106, operated from one side (e.g., the outside of an exterior door 108) by a lock 104 and key 102 and operated from another side (e.g., the inside of an exterior door 108) by a twist knob 112. However, in another embodiment, a lock 104 operable by a key 102 in a lock and key system 100 may be disposed in a casing for another type of locking device. For example, a lock 104 may be a component of a locking door handle, a padlock, a bicycle U-lock, a file cabinet lock, a car ignition lock, or the like. In various embodiments, a lock 104 as disclosed herein may be used in various further applications where another type of lock (e.g., a pin tumbler lock, a wafer tumbler lock, a disc tumbler lock, a lever tumbler lock, an electronic lock operated by a keycard or fob, or the like) might otherwise be used. The lock 104 and key 102 are described in further detail below with reference to subsequent figures.

Figure 2:
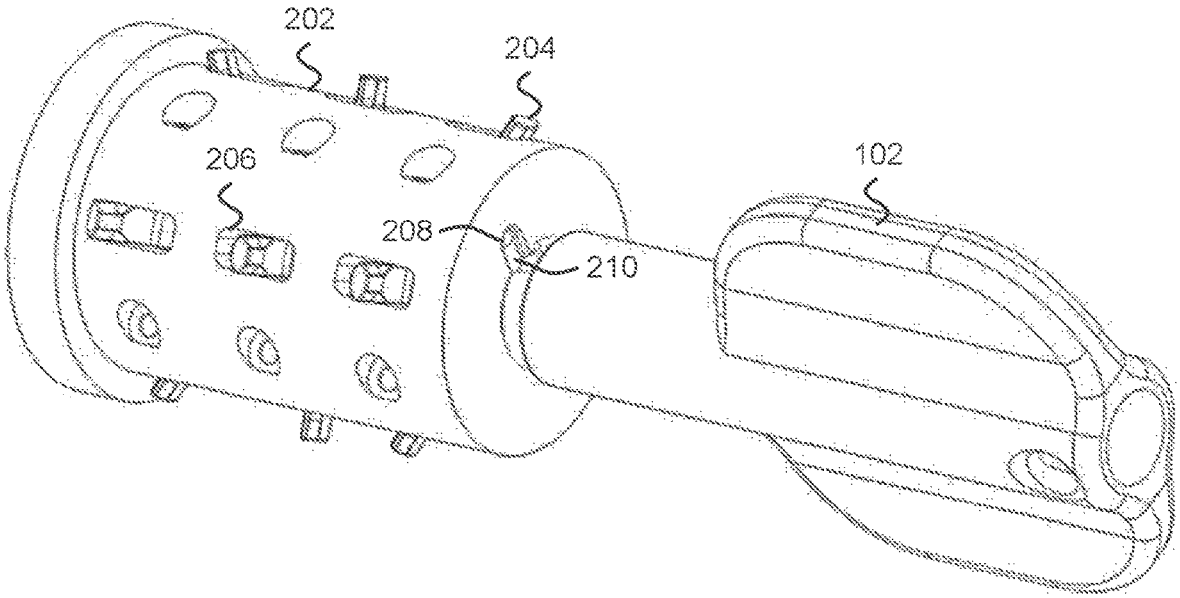
FIG. 2 is a perspective view illustrating components of a lock and key system, in one embodiment.
Figure 4:
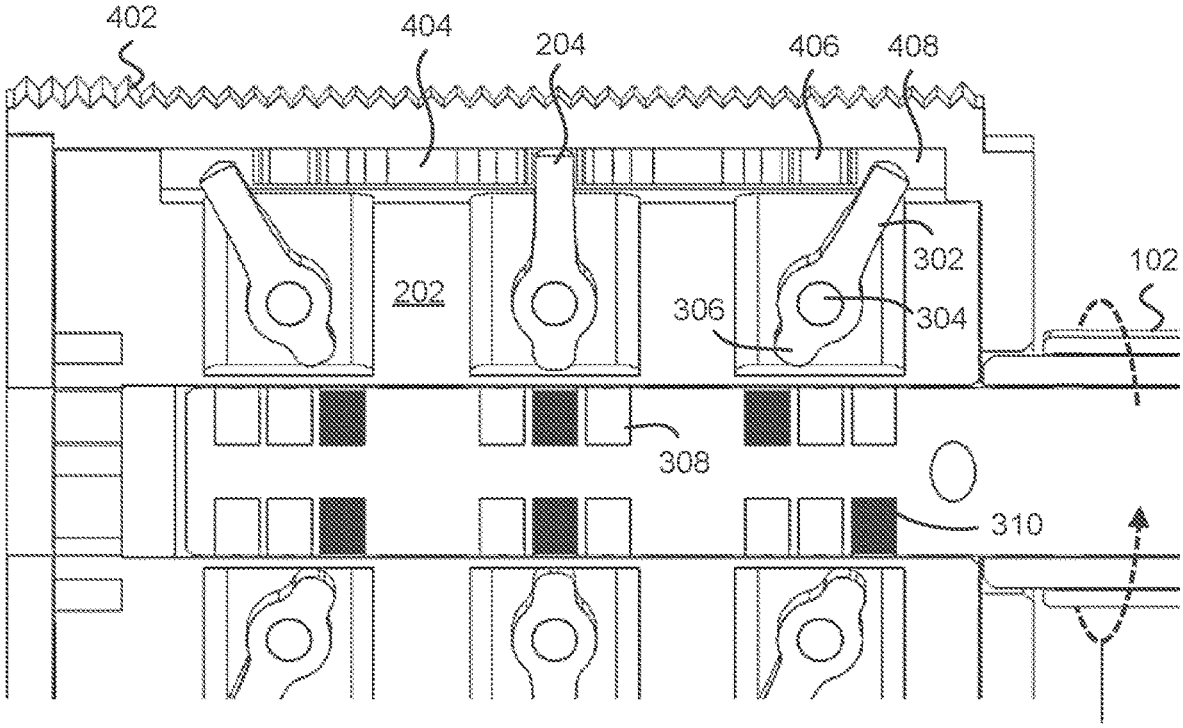
FIG. 4 is a cutaway perspective view illustrating components of a lock and key system, in one embodiment.
Figure 5:
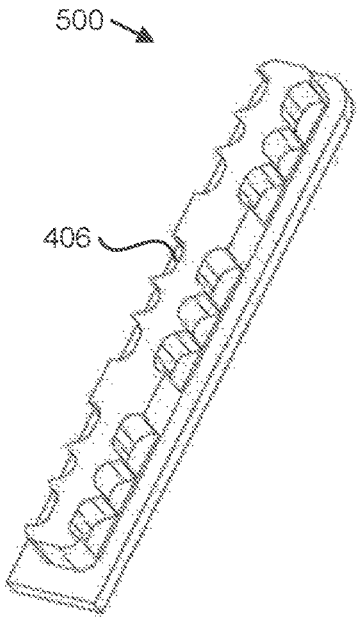
FIG. 5 is a perspective view illustrating one embodiment of a blank for a blocking bar.
Figure 6:
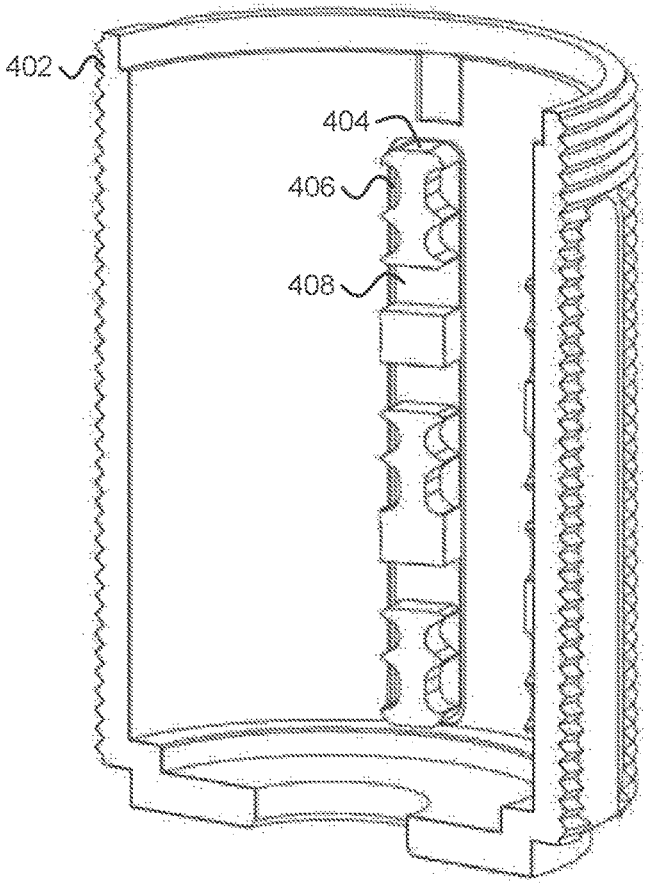
FIG. 6 is a cutaway perspective view illustrating a blocking bar affixed to a housing, in one embodiment.

FIG. 2 depicts components of a lock and key system 100, in one embodiment. In various embodiments, the key 102 may be substantially similar to the key 102 described above with reference to FIG. 1. In the depicted embodiment, a lock 104 (which may be substantially as described above) includes a cylinder 202 disposed in a housing, a plurality of rotors 204, and one or more blocking bars. The housing and blocking bars are not shown in FIGS. 2 and 3, to more clearly depict the cylinder 202 and rotors 204, but are depicted in FIGS. 4-6.

In various embodiments, a cylinder 202 may include a plurality of side openings 206, and an end opening that communicates with an interior recess to admit a key 102. In further embodiments, rotors 204 may be disposed in the side openings 206 and may be pivotably coupled to the cylinder 202 so that outer portions of the rotors 204 extend past an outer surface of the cylinder 202. In certain embodiments, the cylinder 202 may be disposed in a housing, and slotted blocking bars may be affixed in the housing, so that the cylinder 202 can be rotated relative to the housing when the rotors 204 align with slots in the blocking bars, and so that rotation of the cylinder 202 relative to the housing is limited when at least one rotor 204 is non-aligned with a slot.

In further embodiments, a key 102 may include magnets that attract inner portions of the rotors 204, thus affecting whether the outer portions of the rotors 204 are aligned or non-aligned with the slotted blocking bars. Thus, inserting a key 102 with magnets in the correct positions will align outer portions of rotors 204 to the blocking bar slots, permitting the cylinder 202 to be turned, via the key 102, to lock or unlock the lock 104. However, if a key is inserted with magnets in incorrect positions, rotors 204 will be non-aligned with the blocking bar slots, and a user may not be able to turn the key to lock or unlock the lock 104. Similarly, when the correct key 102 is removed from the lock 104, movement of the magnets in the key 102 past the rotors 204 may reposition the rotors 204 to be non-aligned with the blocking bar slots, so that rotation of the cylinder 202 is limited.

As described above, locks where a key mechanically contacts tumblers such as pins, wafers, or levers may be defeated by moving the tumblers into the correct position using a lock pick, or by raking or bumping the pins, or the like. By contrast, in certain embodiments, a lock 104 where rotors 204 are positioned by magnets in a key 102 may be resistant to picking, raking, bumping, or other mechanical manipulation of the rotors 204.

A cylinder 202, in various embodiments, is the part of a lock 104 that is rotated by the key 102 to lock or unlock the lock 104. In various embodiments, a housing may be affixed to the body of a locking device such as a lock casing 106 as shown in FIG. 1, a doorknob, a padlock, or the like. A cylinder 202 may be disposed in the housing, and turning the correct key 102 may rotate the cylinder 202 relative to the housing. Movement of the cylinder 202 is described herein relative to the housing. For example, for a lock 104 used as part of a padlock, a user after inserting the key 102 in the lock 104 may produce the effects of turning the key 102 by rotating the padlock while holding the key 102 (and therefore the cylinder 202) stationary. Such a situation may be described as involving rotation of the cylinder 202 in the housing, even though it actually involves the housing rotating around a stationary cylinder 202.

In certain embodiments, an actuator may be coupled to the cylinder 202, and may be rotated by the cylinder 202 to lock or unlock a lock 104. For example, in the embodiment depicted in FIG. 1, the tailpiece 110 is an actuator that rotates to extend or retract a bolt. In another embodiment, with a lock 104 as part of a padlock, an actuator may be a cam that presses balls into notches in a shackle when the cam is rotated to a first position, thus preventing the shackle from being moved, and that allows the move out of the notches when the cam is rotated to a second position, thus permitting movement of the shackle. Various other or further types of actuators used in pin tumbler locks, wafer tumbler locks, or the like, may similarly be coupled to a cylinder 202 and used in a magnetic keyed lock 104, in various embodiments.

The term "cylinder" is used herein to indicate that in certain embodiments, the cylinder 202 may be approximately cylindrical, or may have an outer surface approximating or bounded by a geometric cylinder. However, the term "cylinder" is not intended in the strict geometric sense of a cylindrical solid or surface. A cylinder 202 may be formed with an interior recess to admit a key 102, side openings 206 to admit rotors 204, or the like, and thus may have asymmetries or other features not present in a geometric cylinder. Additionally, the cylinder 202 may or may not have a constant radius. For example, in the depicted embodiment, the cylinder 202 is wider at the back end than at the front where the key 102 is inserted. The widened portion of the cylinder 202 may facilitate retention and alignment of the cylinder 202 in the housing.

In certain embodiments, the cylinder 202 may be bounded by a surface of rotation generated by rotating a curve around an axis. The outer surface of the cylinder 202, in further embodiments, may include portions that extend to the bounding surface of rotation, and portions (e.g., side openings 206) that do not extend to the bounding surface of rotation, but does not include portions that extend further away from the axis than the bounding surface. However, the rotors 204 may extend further away from the axis than the outer surface or the bounding surface. As such, the cylinder 202, in various embodiments, may be rotatable within the housing, depending on the position of the rotors 204.

In the depicted embodiment, the cylinder 202 is formed with an end opening communicating with an interior recess. The key 102 is inserted or removed through the end opening. With the key 102 inserted (as shown in FIG. 2) the shaft of the key 102 is located within the interior recess. The end opening and/or the interior recess of the cylinder 202 may also be referred to as a keyhole. The key 102, in various embodiments, is shaped to be inserted through the end opening of the cylinder 202 into the interior recess of the cylinder 202. In particular, in certain embodiments, the shaft of the key 102 may be shaped to fit through the end opening and into the interior recess of the cylinder 202. For example, a key 102 may have a flat shaft to fit a slotted interior recess, may have a shaft with a square cross section to fit an interior recess with a square cross section, or the like. As another example, a key 102 may have a cross-shaped shaft, and the end opening of the cylinder 202 could be fitted with a cover made to only admit a cross-shaped shaft and not to admit round-shaped tools that might otherwise be inserted and used to over-torque the lock 104.

In some embodiments, an interior recess that is shaped to transfer torque from a key 102 to the cylinder 202 may also be vulnerable to attacks that apply excessive torque to break rotors 204 or blocking bars, or to otherwise turn the cylinder 202 to unlock the lock 104 without using the correct key 102. Accordingly, in the depicted embodiment, the shaft of the key 102 and the interior recess are cylindrical. A cylindrical interior recess may be resistant to over-torque attacks. However, a cylindrical interior recess may also fail to transmit more than a minimal amount of torque from the key 102 to the cylinder 202.

In the depicted embodiment, therefore, the end opening of the cylinder 202 includes a slot 208, and the key 102 includes a shear pin 210 extending from the shaft. The shear pin 210, in the depicted embodiment, is shaped to engage the slot 208 for transferring torque from the key 102 to the cylinder 202. Aligning the shear pin 210 in the slot 208 may also register the key 102 in the correct position, relative to the rotors 204, for unlocking the lock 104.

A shear pin 210, in certain embodiments, may break by shearing if a preconfigured threshold force is exceeded. In further embodiments, the shear pin 210 may be weaker than the cylinder 202, the rotors 204, and the blocking bars. Thus, in certain embodiments, attempting to over-torque a cylindrical key 102 with a shear pin 210 may break the shear pin 210 so that the key 102 spins freely in the cylinder 202, without damaging the cylinder 202, the rotors 204, or the blocking bars. Additionally, in certain embodiments, providing a cylinder 202 with a cylindrical interior recess and a slot 208 to engage a shear pin 210 may provide a limited attack surface for over-torque attacks using tools other than the key 102. For example, a person attempting to break the lock 104 by applying excess torque with a screwdriver may be limited to screwdrivers that fit in the slot 208. In further embodiments, a face plate may be coupled to the cylinder 202 by one or more shear pins, and the slot 208 may be disposed in the face plate so that over-torque attacks using tools other than the key 102 result in shearing the face plate away from the cylinder, and not in rotation of the cylinder 202 itself.

The cylinder 202, in the depicted embodiment, includes a plurality of side openings 206. Side openings 206, in the depicted embodiment, are indentations or recesses in the otherwise rotationally symmetric outer surface of the cylinder 202. Rotors 204 are disposed in the side openings 206, and pivotably coupled to the cylinder 202. Rotors 204 and side openings 206 are described in further detail below with reference to FIG. 3.

Figure 3:
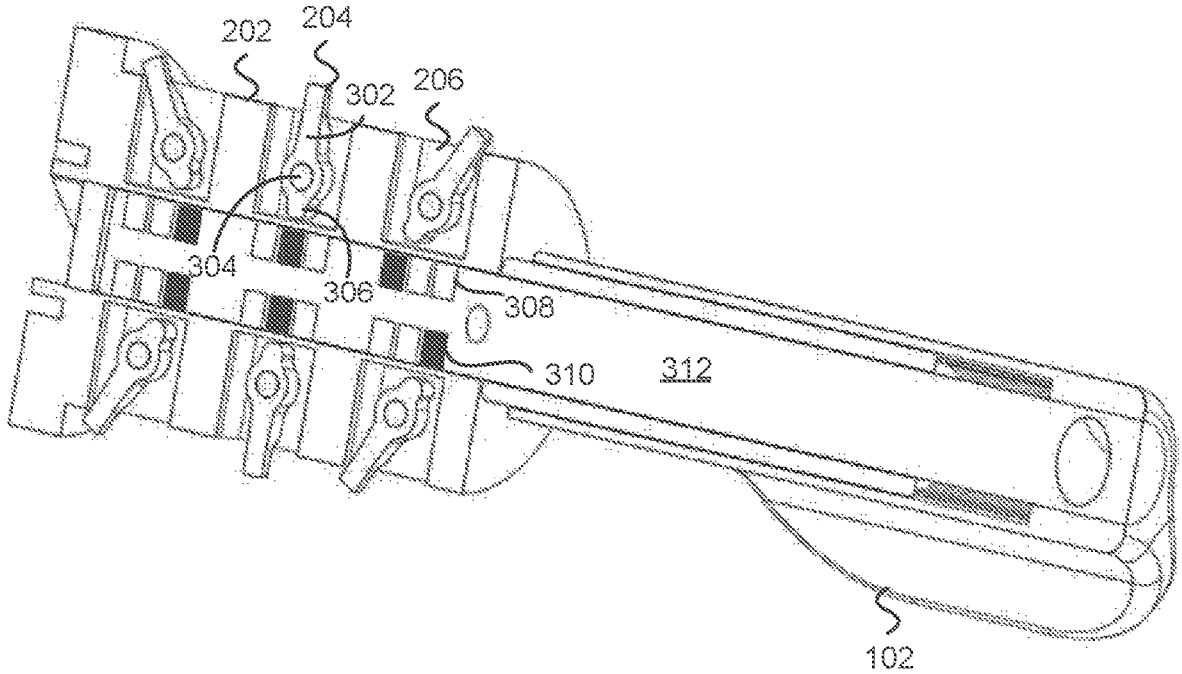
FIG. 3 is a cutaway perspective view illustrating components of a lock and key system, in one embodiment.

FIG. 3 further depicts components of a lock and key system 100, in one embodiment, in a cutaway view. The key 102 and cylinder 202 depicted in FIG. 2 and described above are depicted cut in half in FIG. 3, to illustrate the operation of the key 102 and the rotors 204.

In one embodiment, side openings 206 may be through-holes that communicate with or connect to the interior recess of the cylinder 202 (where the key 102 is disposed in FIG. 3). In the depicted embodiment, however, the side openings 206 are blind holes that do not communicate with or connect to the interior recess of the cylinder 202.

In embodiments where side openings 206 do not communicate with the interior recess, attempts to pick the lock 104 may be frustrated because a lock pick inserted into the interior recess may not be able to reach or contact the rotors 204. In some embodiments, a liner may be disposed in the interior recess of the cylinder 202 to block access to the rotors 204 from the interior recess. In various embodiments, a liner may be affixed to the cylinder 202 or may freely rotate relative to the cylinder 202. A free-rotating liner may prevent or frustrate over-torque attacks on the lock 104. Similarly, a fixed or free-rotating plate made of a harder material than the cylinder 202 (e.g., made of hardened steel) may be disposed at one end of the interior recess, to protect the bottom of the interior recess against drilling attacks.

In the depicted embodiment, rotors 204 are disposed in the side openings 206 and pivotably coupled to the cylinder 202. Rotors 204 may be pivotably coupled to the cylinder 202 via bolts, rivets, pins, or other methods. The rotors 204 are pivotably coupled to the cylinder 202 at pivot points 304. In the depicted embodiment, inner portions 306 of the rotors 204 extend from the pivot points 304 toward the interior recess (e.g., down from the rotors 204 at the top of FIG. 3, and up from the rotors 204 at the bottom of FIG. 3), and outer portions 302 of the rotors 204 extend from the pivot points 304 past the outer surface of the cylinder 202 (where the outer surface is regarded as a surface of rotation not including the indented surface of the side openings 206).

In various embodiments, the inner portion 306 of a rotor 204 may be a first lobe, elongation, or other asymmetry that permits the rotor 204 to be positioned (e.g., in an angular position relative to the pivot point 304) by a magnet 310 in the key 102. The outer portion 302, in further embodiments, may be a second lobe, elongation, or other asymmetry that extends past the outer surface of the cylinder 202, and that is capable of being either aligned or non-aligned with another component such as a slot in a blocking bar, to permit or limit rotation of the cylinder 202. In FIG. 3, the outer portions 302 of the rotors 204 are depicted as diametrically opposed to the inner portions 306, and as longer than the inner portions 306. In another embodiment, with the pivot points 304 closer to the outer surface of the cylinder 202, the outer portions 302 may be shorter than the inner portions 306, or the outer portions 302 and the inner portions 306 may be of equal length. Additionally, the outer portions 302 may be at another angle relative to the inner portions 306, in another embodiment.

In certain embodiments, the size and/or shape of the side openings 206 may be configured to limit rotation of the rotors 204 to a predetermined range. For example, in the depicted embodiment, the width of the side openings 206 allows rotors 204 to move to positions aligned or non-aligned with blocking bars, but limits the rotation of the rotors 204 so that the inner portions 306 remain sufficiently near the interior recess of the cylinder 202 to be affected by magnets 310 in the key 102.

The key 102, in the depicted embodiment, includes a non-magnetic shaft 312 and a plurality of magnets 310 positioned in the shaft 312. Magnets 310 disposed in a non-magnetic shaft 312 may attract the inner portions 306 of the rotors 204 towards the magnets 310, thus also positioning the outer portions 302. The term "non-magnetic," as used herein, refers to materials that do not conduct appreciable magnetic flux, or are not significantly magnetized or magnetizable in the presence of the magnets 310, and that are thus not strongly attracted to or repelled by the magnets 310. However, a "non-magnetic" material may be weakly attracted to a magnet 310 and may still be referred to as "non-magnetic." For example, a generally non-magnetic stainless steel alloy may have some number of magnetic inclusions, impurities, or defects, but may still be referred to as "non-magnetic." In various embodiments, a non-magnetic shaft 312 for a key 102 may be formed of a non-magnetic material such as stainless steel, plastic, ceramic, aluminum, brass, zinc, or the like. Disposing magnets 310 in a non-magnetic shaft 312, in various embodiments, may provide a magnetic field that is localized to be strongest at the magnets 310, thus attracting the inner portions 306 of the rotors 204 to the locations of the magnets 310.

The cylinder 202, in various embodiments, may similarly be made from or may include a non-magnetic material. With a non-magnetic key shaft 312 and cylinder 202, the magnetic interaction between the magnets 310 and the rotors 204 is not disturbed by the surrounding material of the shaft 312 or cylinder. Additionally, in further embodiments, the cylinder 202 may be made from or may include a non-galling, low debris-generating, or low friction material. Providing a non-galling, low debris-generating, or low friction cylinder 202 may avoid wear that might otherwise occur due to sliding friction as the cylinder 202 rotates in the housing. Non-magnetic, non-galling (or low debris-generating or low friction) materials suitable for forming the cylinder 202, in various embodiments, may include non-galling phosphor bronze, the stainless steel alloy provided under the Nitronic 60 trademark, or the like.

In the depicted embodiment, as shown in FIGS. 2 and 3, rotors 204 are disposed both along and around the cylinder 202. Rotors 204 disposed along the cylinder 202 may be at different depths relative to the end opening where the key 102 is inserted. Similarly, rotors 204 disposed around the cylinder 202 may be at different angular positions relative to the slot 208 for the shear pin 210. Magnets 310 are similarly disposed along and around the shaft 312 of the key 102, in the depicted embodiment. In certain embodiments, the key 102 includes a number of magnets 310 equal to the number of rotors 204 in the cylinder 202, so that when the key 102 is inserted into the cylinder 202, each magnet 310 positions one rotor 204 by attracting the inner portion 306 of that rotor 204. In one embodiment, rotors 204 and magnets 310 may be disposed linearly along the cylinder 202 and the shaft 312, but at a single angular position. In another embodiment, rotors 204 and magnets 310 may be disposed at multiple angular positions around the cylinder 202 and the shaft 312, but at a single linear position. In the depicted embodiment, however, rotors 204 and magnets 310 are disposed both around and along the cylinder 202 and the shaft 312, respectively. In various embodiments, varying the depth or the angle of the rotors 204 may make it difficult to manipulate individual rotors 204 (e.g., with a small magnet at the end of a lock pick). Thus, in further embodiments, varying the depth and the angle of the rotors 204 may make it even more difficult to pick the lock 104 by manipulating individual rotors 204.

In the depicted embodiment, each magnet 310 may be in one of three recesses 308 corresponding to three different positions for the corresponding rotor 204. A bonding material such as epoxy, another glue, plastic, or the like, may be used to secure the magnet 310 in one of the recesses 308 and to fill empty recesses 308. Additionally, in the depicted embodiment, twelve rotors 204 are provided at three depths and four angular locations around the cylinder 202. With twelve three-position rotors 204, the number of possible key combinations (e.g., magnet placement patterns) is 3^12, or 531,441. In another embodiment, a different number of magnet recesses 308 or possible positions per rotor 204 may be provided, and/or a different number of rotors 204 may be provided. If the number of positions per rotor 204 is N and the number of rotors 204 is M, then the number of possible combinations or magnet placement patterns will be N^M. For example, in one embodiment, a lock 104 may include fewer rotors 204 than in the depicted embodiment, thus decreasing the complexity and expense of the lock 104 with some reduction in security. In another embodiment, a lock 104 may include more rotors 204 than in the depicted embodiment, thus increasing the security of the lock 104, but with a corresponding increase in complexity and expense. In one embodiment, a lock 104 may include eight rotors 204. In another embodiment, a lock 104 may include sixteen rotors 204. In another embodiment, a lock 104 may include a number of rotors 204 between eight and sixteen.

In certain embodiments, at least the inner portion 306 of the rotors 204 includes a magnetic material. The term "magnetic" is used herein with reference to materials that conduct magnetic flux and are strongly attracted to magnets. Magnetic materials that may be used in the rotors 204 include iron, cobalt, rare earth metals, magnetic alloys of the above, and the like. In various embodiments, magnetic material in the inner portion 306 of a rotor 204 may be attracted to the corresponding magnet 310 in the key 102. In further embodiments, the attraction between a magnet 310 and the inner portion 306 of the rotor 204 may be accomplished by the use of a soft magnetic material irrespective of the orientation of the magnet 310, so that inner portion 306 of the rotor 204 is attracted even if the orientation of the magnet 310 is reversed.

In certain embodiments, a rotor 204 may be permanently magnetized, or may include a magnet that is attracted to a magnet 310 in the key 102. However, because attraction between two magnets is orientation-sensitive, it may be more difficult to produce a key 102 with correctly oriented magnets 310. By contrast, in another embodiment, a rotor 204 does not include a magnet and is not permanently magnetized. For example, a rotor 204 made from a soft magnetic material, which does not substantially retain its magnetism in the absence of an external field, may have a residual magnetic field that is zero or weak enough that the rotor 204 or the inner portion 306 is attracted to a magnet 310 in the key 102 regardless of the orientation of the magnet 310. Using a soft magnetic material for a rotor 204, or for an inner portion 306 of a rotor 204, allows keys 102 to be produced based on magnet locations but without the difficulty of correctly orienting the magnets 310. Additionally, the use of a soft magnetic material for rotors 204 instead of a permanent magnet (made of a hard magnetic material) may make it more difficult for an unauthorized person to move the rotors 204 without a key 102, or to gain information about the position of the rotors 204 by attempting to detect the inherent magnetic field of the rotors 204. The term "soft" as used herein may refer to a magnetic material with a coercivity of less than 1000 A/m.

FIG. 4 further depicts components of a lock and key system 100, in one embodiment. A cutaway view is presented, as in FIG. 3. In the depicted embodiment, the lock and key system 100 include a key 102, including magnets 310 and recesses 308, and a lock 104, including a cylinder 202 and rotors 204 coupled to pivot points 304, with outer portions 302 of the rotors 204 and inner portions 306 of the rotors 204, all of which may be substantially as described above. In the depicted embodiment, the cylinder 202 is disposed in a housing 402, and one or more blocking bars 404 are attached to the housing 402.

The housing 402, in various embodiments, surrounds the cylinder 202. The cylinder 202 may rotate relative to the housing 402 when the rotors 204 are correctly aligned relative to the blocking bar 404. (Otherwise, rotation of the cylinder 202 is limited). In some embodiments, a detent or dimple in the housing 402 and a spring-loaded ball in the cylinder 202 may bias the cylinder into one or more angular positions, such as a "reset" position where the rotors 204 are not engaged with the blocking bar(s) 404. With the cylinder 202 biased into the reset position, magnets 310 in the key 102 may reliably position the rotors 204 before the cylinder 202 is rotated relative to the housing 402. When torque is applied to the cylinder 202, the ball may exit the dimple, compressing the spring, thus permitting the cylinder 202 to rotate so that the rotors 204 engage the blocking bar(s) 404. In another embodiment, an alignment or biasing mechanism other than a ball and detent mechanism may be used to bias the cylinder 202 into a reset position, or an alignment or biasing mechanism may be omitted.

In the depicted embodiment, the housing 402 is threaded. In certain embodiments, a lock 104 with a threaded housing 402 may be screwed into a lock casing 106 as shown in FIG. 1, or into the body of another locking device such as a padlock or the like, and may be secured with set screws, or otherwise affixed to the rest of the locking device. (Set screws or other fasteners may be disposed so that they are only accessible when the lock 104 is unlocked.) Certain other locks such as pin tumbler locks, wafer tumbler locks, or the like, may include threaded housings of a standard size to facilitate replacement of the lock, and a magnet keyed lock 104 may use a similar housing 402 with the same threading, for interchangeability. In another embodiment, however, a housing 402 may be non-threaded, and may be removable or interchangeable using another method of fastening the housing 402 to other components, or may be integrated with or permanently affixed to the body of a padlock, a lock casing 106, or the like, without being removable or interchangeable.

One or more blocking bars 404, in various embodiments, are affixed to the housing 402. A single blocking bar 404 is depicted in FIG. 4, which engages the rotors 204 depicted at the top of FIG. 4. Additional blocking bars 404 may engage other rotors 204 disposed at other angular positions around the cylinder 202. A blocking bar 404, in various embodiments, may be a component or set of components that extends from the housing 402 toward the cylinder 202, and that collides with a rotor 204, thus preventing rotation of the cylinder 202 in a direction that would take the rotor 204 past the blocking bar 404, unless the rotor 204 is aligned with a slot, gap, or other opening in the blocking bar 404. A blocking bar 404 may include a single component with one or more notches for slots or may be a plurality of components disposed on either side of the slots. One or more blocking bars 404 may be affixed to the housing 402 in various ways. For example, blocking bars 404 may be welded to the housing 402, bolted to the housing 402, disposed in slots in the housing 402, or the like. In a further embodiment, blocking bars 404 formed integrally as part of the housing 402 may also be referred to as affixed to the housing 402.

The blocking bars 404, in various embodiments, are formed with a plurality of slots 408. Slots may refer to openings that allow outer portions 302 of rotors 204 to move past the blocking bar 404 when the cylinder 202 is rotated. FIG. 4 depicts a correct key 102 inserted in the lock 104, where rotation of the key 102 and the cylinder 202 is indicated by a dashed arrow. With the correct key 102 inserted in the lock 104, the inner portions 306 of the rotors 204 are attracted to the magnets 310 in the key 102, thus aligning the outer portions 302 of the rotors 204 with slots 408. In the depicted embodiment, the slots 408 include two slots 408 at the end of the blocking bar 404 and one slot 408 in the center of the blocking bar 404. Slots 408 may be at different locations in different embodiments, allowing different locks 104 to be keyed differently. A slot 408 may be a gap, opening or other region in which material of the blocking bar 404 does not block a rotor 204 from being moved past the blocking bar 404 as the cylinder 202 rotates. Thus, in one embodiment, a slot 408 may be a gap between two rotor-blocking portions of a blocking bar 404. In certain embodiments, a slot 408 at the end of a blocking bar 404 may be an open space with a rotor-blocking portion of the blocking bar 404 one on side. Thus, where a blocking bar 404 is shortened rather than being literally slotted, the resulting opening may nevertheless be referred to as a slot 408.

The slots 408 are disposed so that rotation of the cylinder 202 is permitted when the rotors 204 are aligned with the slots 408. Thus, turning the key 102 in the direction indicated by the dashed arrow will turn the cylinder, moving the rotors 204 (or their outer portions 302) through the slots 408. When the correct key 102 is removed, the rotors 204 may be repositioned under their own weight, and/or by the motion of the magnets 310 in the key 102 past the rotors 204, to positions where at least one rotor 204 is non-aligned with a slot 408. Similarly, if an incorrect key is inserted, magnets in incorrect positions may position at least one rotor 204 to be non-aligned with a slot 408. The blocking bars 404 and slots 408 are disposed so that rotation of the cylinder 202 is limited when at least one rotor 204 is non-aligned with a slot 408.

As used herein, terms such as "permitted" or "limited" may be used in reference to rotation of the cylinder 202 in a direction and to an extent that unlocks the lock 104. When rotors 204 are aligned to slots 408 in a blocking bar 404, the cylinder 202 may be rotated in a direction that moves the rotors 204 past that blocking bar 404, but another blocking bar 404 may block the rotors 204. For example, with rotors 204 and blocking bars 404 disposed every 90 degrees around the cylinder 202 and housing 402, it may be possible to rotate the cylinder 202 no further than a quarter turn. Nevertheless, that alignment of the rotors 204 may still be referred to as a state in which rotation is "permitted." Conversely, some rotation of the cylinder 202 may still occur when at least one rotor 204 is non-aligned with a slot 408. For example, the cylinder 202 may be rotated in the indicated direction by a small amount before the rotor 204 contacts the blocking bar 404. Also, unless a pair of blocking bars 404 is provided on each side of a line of rotors 204, the cylinder 202 may be rotated a considerable amount opposite to the indicated direction (e.g., nearly a quarter turn in the depicted embodiment) before the rotors 204 contact a blocking bar 404 for another line of rotors 204. Nevertheless the non-alignment of at least one rotor 204 to the slots 408 may be referred to as a state in which rotation of the cylinder 202 is "limited," because the possible amount of rotation in the indicated direction is not sufficient to unlock the lock 104, and because the rotation in the non-indicated direction is not in a direction that unlocks the lock 104.

In certain embodiments, one or more blocking bars 404 may be formed with a plurality of blind openings 406. A blind opening 406, in various embodiments, may be a gap, indentation, depression, hole, or the like that opens onto one side of the blocking bar 404 (e.g., to the side where the rotors 204 are disposed), but that does not extend through to the blocking bar 404 to the other side. A blind opening 406 may at least partially admit a rotor 204 when the cylinder 202 is turned in the indicated direction, but may prevent the rotor 204 from moving past the blocking bar 404. In further embodiments, blind openings 406 are shaped to arrest the motion of rotors 204 that are non-aligned with slots 408, so that a rotor 204 that engages a blind opening 406 is prevented from aligning with a slot 408. A rotor 204 that engages a blind opening 406 may be a rotor 204 that has at least partially entered the blind opening 406. Walls of the blind opening 406 may prevent the rotor 204 from being repositioned to align with a slot 408. Thus, the motion of the rotor 204 is arrested until the cylinder 202 is rotated back to an initial position.

A variety of lockpicking methods rely on applying enough torque to a keyway to bind components such as pin or wafer tumblers in place, while manipulating the components one at a time into a position that allows a lock to be opened. By analogy, a person attempting to pick the lock 104 might attempt to rotate the cylinder 202 in the direction that unlocks the lock 104, and might use a magnetic pick to attempt to reposition the rotors 204 by sliding the outer portion 302 of a rotor 204 along the blocking bar 404 until the outer portion 302 enters or engages a slot 408. Very small irregularities in positioning of the rotors 204 might then allow a rotor 204 that was fractionally nearer to the blocking bar 404 than the other rotors 204 to be retained in the slot 408 while the next nearest rotor 204 was moved into alignment with its slot 408. The process of retaining rotors 204 in slots 408 while moving an additional rotor 204 into a slot 408 might be repeated until all rotors 204 were aligned with slots 408 and the lock 104 could be opened.

However, a blocking bar 404 formed with blind openings 406 may frustrate such an attempt at lockpicking, because the outer portions 302 of rotors 204 would not slide along the blocking bar 404 into slots 408. Rather, a rotor 204 that engaged or at least partially entered a blind opening 406 would be prevented from aligning with a slot 408. Rotating the cylinder 202 so that one rotor 204 was no longer held in place in a blind opening 406 would also result in other rotors 204 not being held in place in slots 408, thus preventing a lockpicker from moving rotors 204 into position one at a time.

In the depicted embodiment, outer portions 302 of the rotors 204 are chamfered to guide the rotors 204 into the slots 408 or the blind openings 406. In various embodiments, outer portions 302 of the rotors 204 may be chamfered, beveled, tapered, rounded, or the like, to facilitate engagement of the rotors 204 with blind openings 406 or slots 408. In another embodiment, however, rotors 204 may be squared off to require more precise alignment with slots 408 before unlocking the lock 104, thus creating a higher-security lock 104 but with higher expense for more precisely positioning magnets 310 in the key 102.

In certain embodiments, the one or more blocking bars 404 are disposed such that the plurality of rotors 204 simultaneously engage the one or more blocking bars 404. A rotor 204 may be referred to as engaging a blocking bar 404 if the rotor 204 has engaged or at least partially entered a blind opening 406 or a slot 408. Given that it may be impossible, impractical, or costly to avoid some small irregularities in alignment, turning the cylinder 202 through some very small angle may result in one rotor 204 engaging a blind opening 406 or a slot 408 (and thus being held in that alignment) before another rotor 204 (which would then be manipulatable by a magnetic pick). Nevertheless, rotors 204 may be referred to as "simultaneously" engaging the blocking bars 404 if, in some angular position for the cylinder 202, all the rotors 204 have engaged or at least partially entered blind openings 406 and/or slots 408. With blocking bars 404 positioned so that rotors 204 thus simultaneously engage the blocking bars 404, a person attempting to pick the lock 104 by applying enough torque to hold rotors 204 in alignment with slots 408 would find that other rotors 204 engaged with blind openings 406 were prevented from being realigned with slots 408. Blocking bars 404 are depicted in further detail below with reference to FIGS. 5 and 6.

FIG. 5 depicts one embodiment of a blank 500 for a blocking bar 404. The blank 500 includes a base for affixing the blocking bar 404 to the housing 402, and includes blind openings 406, but does not include slots 408. Forming a blocking bar 404 with slots 408 and blind openings 406 may include providing a blank 500 with blind openings 406, then cutting the slots 408. Thus, a manufacturer of a lock 104 may inexpensively manufacture multiple blanks 500, and make blocking bars 404 for a lock 104 by cutting slots 408 in the correct locations for that lock 104. Similarly, in certain embodiments, blocking bars 404 may be removable from the housing 402 if the lock 104 is disassembled, and the lock 104 may be rekeyed by removing blocking bars 404, cutting slots 408 in blanks 500 to form new blocking bars 404, and affixing the new blocking bars 404 to the housing 402.

FIG. 6 depicts a blocking bar 404 affixed to a housing 402, in one embodiment. As described above, a blocking bar 404 may be affixed to a housing 402 by welding, bolting, sliding a base of a blocking bar 404 into a slot in the housing 402, forming a blocking bar 404 integrally with the housing 402, or the like. FIG. 6 is a cutaway view to more clearly show the slot 408 and blind openings 406 that are described above with reference to FIG. 4. It may be seen that a slot 408 extends through the blocking bar 404 but that a blind opening 406 does not, thus permitting rotation of the cylinder 202 to unlock the lock 104 only when all the rotors 204 are aligned with the slots 408, and limiting rotation of the cylinder 202 when at least one rotor 204 is non-aligned with its slot 408 (e.g., when a rotor 204 is aligned with a blind opening 406).

In FIG. 6, one blocking bar 404 is clearly visible, and another is partially visible towards the cutaway edge of the housing 402. In certain embodiments, with rotors 204 disposed around the cylinder 202 at multiple angular positions, blocking bars 404 may similarly be disposed around the housing 402 at multiple angular positions corresponding to the rotor positions, so that rotors 204 engage the blocking bars 404 simultaneously. For example, in the depicted embodiment, blocking bars 404 are disposed at four angular positions around the housing 402 (two of which are visible in the cutaway view), corresponding to four angular positions of rotors 204 around the cylinder 202.

In some embodiments, the blocking bars 404 include one slot 408 per rotor 204 and at least one blind opening 406 per rotor 204. A blocking bar 404 may include one blind opening 406 per rotor 204, two blind openings 406 per rotor 204, or more than two blind openings 406 per rotor 204. For example, in the depicted embodiment, a blocking bar 404 engages three rotors 204 (as shown in FIG. 4), and a blank 500 (as shown in FIG. 5) includes three groups of three blind openings 406, with the three groups corresponding to the three rotors 204. The blocking bar 404 shown in FIG. 6 has one slot 408 cut in each of the three groups, in place of a blind opening 406 in the blank 500. Thus, each rotor 204 has one correct position aligned with a slot 408, and two (or more, in other embodiments) incorrect positions aligned with blind openings 406, making it very difficult or unlikely for someone without the correct key 102 to simultaneously align all the rotors 204 in correct positions to open the lock 104.

Figure 7:
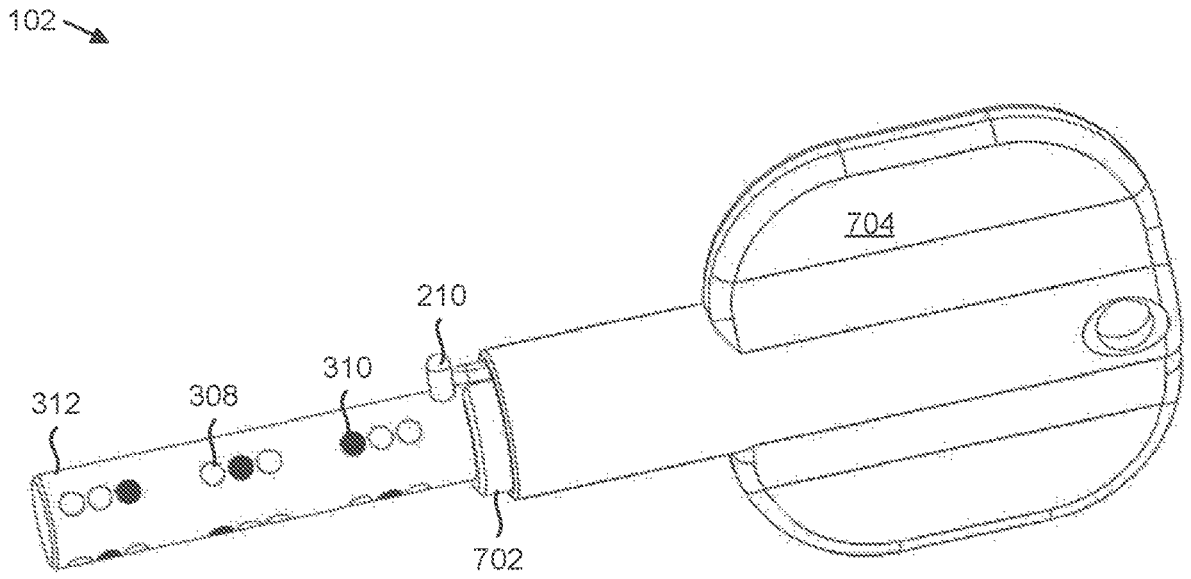
FIG. 7 is a perspective view illustrating one embodiment of a key.

FIG. 7 is a perspective view illustrating one embodiment of a key 102. The key 102 in the depicted embodiment may be substantially similar to the key 102 described above with reference to previous figures, including a non-magnetic shaft 312, a plurality of magnets 310 positioned in the shaft 312, recesses 308, and a shear pin 210 for transferring torque from the key 102 to the cylinder 202.

The magnets 310, in the depicted embodiment, may be samarium cobalt magnets (for high magnetic strength and corrosion resistance), neodymium magnets, other rare earth magnets, ferrite or ceramic magnets, or the like. In various embodiments, the magnets 310 are positioned in the shaft 312 based on positions of the slots 408 in the one or more blocking bars 404. For example, the positions of slots 408 in the blocking bars 404 determines what position of outer portions 302 of rotors 204 permits rotation of the cylinder 202, which in turn determines what position of inner portions 306 of the rotors 204 correctly aligns the outer portions 302. That, in turn, determines what position of magnets 310 in the shaft 312 attracts the inner portions 306 of the rotors 204 to the correct positions. Thus, when the key 102 is inserted into the cylinder 202, the inner portions 306 of the rotors 204 align to magnet positions, resulting in the outer portions 302 of the rotors 204 aligning to the slots 408 in the blocking bars 404, allowing the key 102 to be turned to turn the rotate the cylinder 202 and unlock the lock 104.

As described above, in some embodiments, the shaft 312 of the key 102 and the interior recess of the cylinder 202 are both cylindrical. In certain embodiments, rotors 204 are disposed around and along the cylinder 202, and magnets 310 are disposed around and along the shaft 312. In some embodiments, the shaft 312 may include slots between the rows of magnets, with corresponding protrusions, obstructions, or warding in the end opening and/or the the interior recess of the cylinder 202, thus allowing the shaft 312 to enter the lock 104 but preventing larger tools that might be used in an over-torque attack from passing the warding.

In one embodiment, positioning or disposing magnets 310 in the shaft 312 may include forming recesses 308 at magnet locations, disposing magnets 310 in the recesses 308, and bonding the magnets 310 in the recesses 308 with a bonding material such as epoxy, cyanoacrylate, or another glue. In the depicted embodiment, the shaft 312 includes recesses 308 at multiple possible magnet locations, and magnets 310 are secured in some of the recesses 308. The recesses 308 are in groups, where the shaft 312 includes groups of recesses 308 at positions in the shaft 312 corresponding to positions of rotors 204 in the cylinder 202. For example, in the depicted embodiment, twelve rotors 204 are disposed in the cylinder 202, the blocking bars 404 include twelve corresponding groups of one slot 408 and two blind openings 406 (corresponding to three possible positions for each rotor 204), and the key 102 similarly includes twelve groups of three recesses 308, corresponding to the twelve rotors 204 and the three possible positions for each rotor 204. Thus, in the depicted embodiment, a group of recesses 308 includes three recesses 308 corresponding to three possible positions of slots 408 in the one or more blocking bars 404 (and therefore corresponding to three possible "correct" positions for a rotor 204). More generally, in various embodiments, with various numbers of rotors 204 and possible "correct" rotor positions/alignments, a shaft 312 may include groups of recesses 308 where a group of recesses 308 corresponds to one rotor 204, and where the recesses 308 in a group correspond to possible "correct" positions for that rotor 204 (e.g., possible positions of slots 408 in a blocking bar 404).

In the depicted embodiment, the magnets 310 are secured in the recesses 308 with a bonding material, such as glue, plastic, or the like, and other recesses 308 (which do not contain magnets 310) are filled with the bonding material. Filling the recesses 308 with the bonding material may prevent the recesses 308 from accumulating pocket lint or debris that might then fall out of the recesses 308 into the cylinder 202. Additionally, if the bonding material is opaque and covers the magnets 310, filling the recesses 308 may prevent someone from duplicating the key 102 based on a photograph or video, by preventing the magnet positions from being directly observed or inferred from positions of empty recesses 308.

In the depicted embodiment, the key 102 includes a sleeve 702 and a key handle 704. A key handle 704, in various embodiments, may be coupled to the shaft 312 or integrally formed with the shaft 312, and may extend laterally from the shaft 312 providing leverage for a user to apply torque to turn the key 102. Various types of key handles 704 used for car keys, house keys, or other keys may also be used with a key 102.

In some embodiments, a key 102 includes a non-magnetic sleeve 702 surrounding at least a portion of the shaft 312. In some embodiments a sleeve 702 may be removable. In some embodiments, the key handle 704 may be formed with an opening permitting the sleeve 702 to retract into the opening when the key 102 is in use. The sleeve 702 is depicted as retracted into the key handle 704 in FIG. 7.

Figure 8:
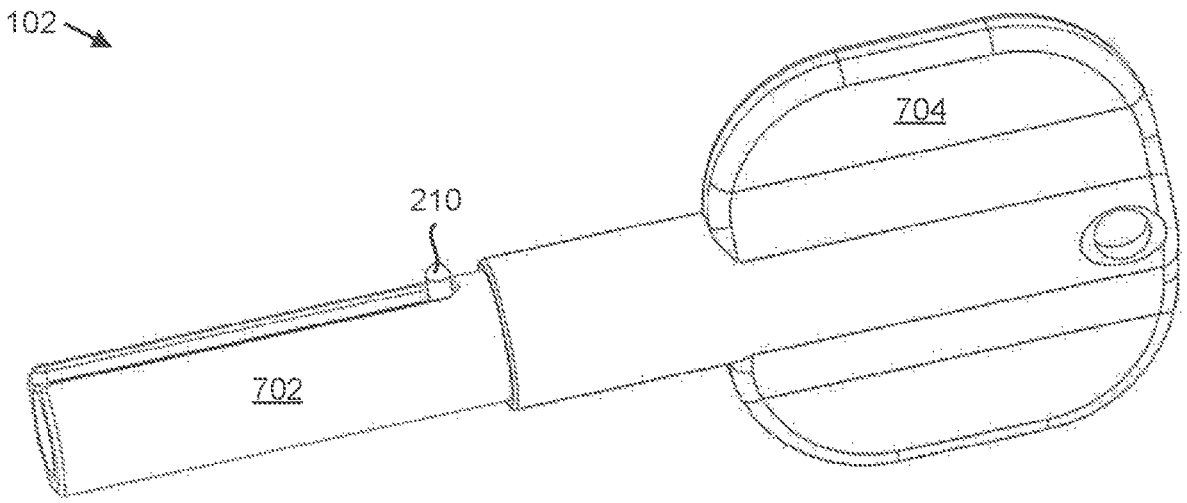
FIG. 8 is a perspective view further illustrating the key of FIG. 7.
Figure 9:
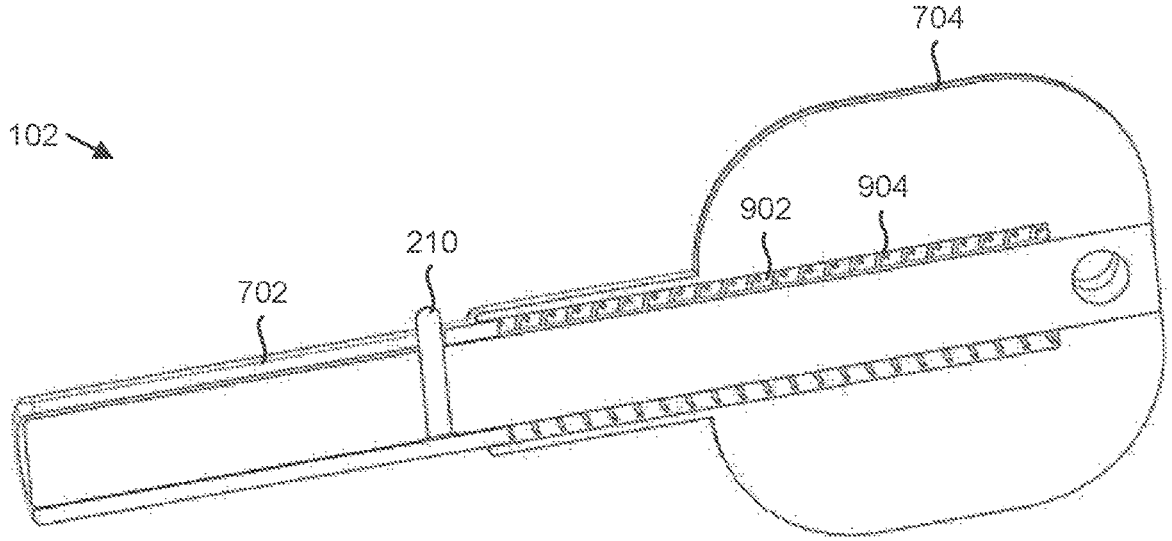
FIG. 9 is a cutaway perspective view further illustrating the key of FIG. 7.

FIGS. 8 and 9 further depict the key 102 as described above with reference to FIG. 7, with the sleeve 702 extended. FIG. 8 depicts a perspective view of the key 102 and FIG. 9 depicts a cutaway view.

A sleeve 702 may be referred to as surrounding the shaft 312 if it covers a substantial portion of a region of the shaft 312 where the magnets 310 are located. For example, in the depicted embodiment, the sleeve 702 is shorter than the full shaft 312, but covers the part of the shaft 312 not covered by the key handle 704. At the depicted length, the sleeve 702 can be retracted into an opening 902 in the key handle 704. Additionally, in the depicted embodiment, the sleeve 702 includes a slot to accommodate the shear pin 210. Nevertheless, the depicted sleeve 702 may still be referred to as surrounding the shaft 312.

In some embodiments, a non-magnetic sleeve 702 may prevent magnetic materials in a user's pockets from sticking to the magnets 310. In certain embodiments, a non-magnetic sleeve 702 may prevent the magnets 310 from interfering with magnetically sensitive items such as credit card magnetic stripes. A non-magnetic sleeve 702 may be made from bronze, brass, high-strength plastic, or another non-magnetic material or combination of materials. In various embodiments, a sleeve 702 may be moved to uncover the magnets 310 when the key 102 is inserted into the lock 104. In one embodiment, a sleeve 702 may be a removable component of the key 102. In another embodiment, a sleeve 702 may be retractable into the key handle 704.

In the depicted embodiment, the key handle 704 is formed with an opening 902, permitting the sleeve 702 to retract into the opening 902 when the key 102 is in use. In certain embodiments, the sleeve 702 may be larger than the end opening or interior recess of the cylinder 202, so that inserting the key 102 into the lock 104 pushes the sleeve 702 back into the opening 902 without a user separately retracting or removing the sleeve 702.

In a further embodiment, a compression spring 904 is disposed in the opening 902 of the key handle 704 to bias the sleeve 702 into a position covering the magnets 310 when the key 102 is not in use. For example, as the key 102 is removed from the lock 104, the compression spring 904 may push the sleeve 702 back into a default position covering the magnets 310. In the depicted embodiment, the sleeve 702 is retained by the shear pin 210. A slot allows the sleeve 702 to retract past the shear pin 210, but the slot does not extend to the other end of the sleeve 702. Thus, when the compression spring 904 extends the sleeve 702 from a retracted position back to a position covering the magnets 310, the motion of the sleeve 702 ends when the end of the slot contacts the shear pin 210

Figure 10:
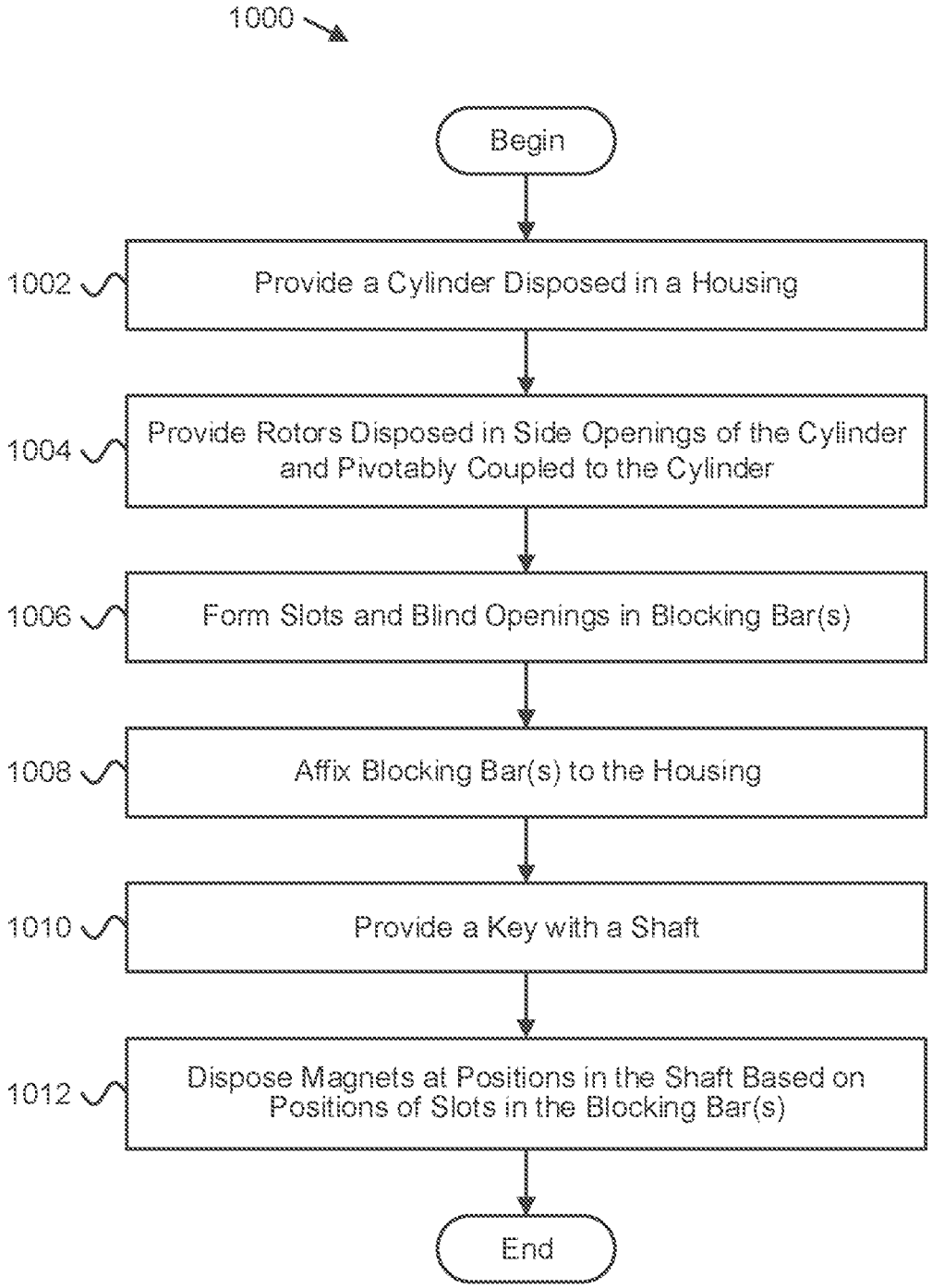
FIG. 10 is a schematic flow chart diagram illustrating one embodiment of a method for magnetic keyed locking.

FIG. 10 is a schematic flow chart diagram illustrating one embodiment of a method 1000 for magnetic keyed locking. The method 1000 begins with providing 1002 providing a cylinder 202 disposed in a housing 402. The cylinder 202 is formed with an end opening and a plurality of side openings

206. The end opening communicates with an interior recess. The method 1000 includes providing 1004 a plurality of rotors 204 disposed in the side openings 206 and pivotably coupled to the cylinder 202. In further embodiments, the rotors 204 include inner portions 306 that extend from pivot points 304 toward the interior recess, and outer portions 302 that extend from the pivot points 304 past an outer surface of the cylinder 202. The method 1000 includes forming 1006 a plurality of slots 408 and a plurality of blind openings 406 in one or more blocking bars 404. The method 1000 includes affixing 1008 the blocking bars 404 to the housing 402 such that rotation of the cylinder 202 is permitted when the rotors 204 are aligned with the slots 408 and limited when at least one rotor 204 is non-aligned with a slot 408. The method 1000 includes providing 1010 a key 102 with a shaft 312 shaped to be inserted into the interior recess of the cylinder 202. The method 1000 includes disposing 1012 magnets 310 at positions in the shaft 312 based on positions of the slots 408 in the one or more blocking bars 404, such that when the key 102 is inserted into the cylinder 202, the inner portions 306 of the rotors 204 align to magnet positions, resulting in the outer portions 302 of the rotors 204 aligning to the slots 408, and the method 1000 ends.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a cylinder disposed in a housing, the cylinder formed with an end opening and a plurality of side openings, the end opening communicating with an interior recess;

a plurality of rotors disposed in the side openings and pivotably coupled to the cylinder, the rotors comprising inner portions that extend from pivot points toward the interior recess, and outer portions that extend from the pivot points past an outer surface of the cylinder; and one or more blocking bars affixed to the housing, the one or more blocking bars formed with a plurality of slots and disposed such that rotation of the cylinder is permitted when the rotors are aligned with the slots and limited when at least one rotor is non-aligned with a slot.

2. The apparatus of claim 1, wherein the one or more blocking bars are formed with a plurality of blind openings shaped to arrest the motion of rotors that are non-aligned with slots such that a rotor that engages a blind opening is prevented from aligning with a slot.

3. The apparatus of claim 2, wherein the one or more blocking bars are disposed such that the plurality of rotors simultaneously engage the one or more blocking bars.

4. The apparatus of claim 2, wherein the one or more blocking bars comprise one slot per rotor and at least one blind opening per rotor.

5. The apparatus of claim 2, wherein the outer portions of the rotors are chamfered to guide the rotors into the slots or the blind openings.

6. The apparatus of claim 1, wherein the side openings do not communicate with the interior recess.

7. The apparatus of claim 1, wherein the rotors are disposed along and around the cylinder.

8. The apparatus of claim 1, wherein the plurality of rotors comprises eight to sixteen rotors.

9. The apparatus of claim 1, wherein at least the inner portions of the rotors comprise a magnetic material.

10. The apparatus of claim 1, wherein the rotors do not comprise magnets.

11. The apparatus of claim 1, wherein the cylinder comprises a non-magnetic, non-galling material.

12. The apparatus of claim 1, further comprising a key shaped to be inserted through the end opening into the interior recess, the key comprising:

a non-magnetic shaft; and a plurality of magnets positioned in the shaft based on positions of the slots in the one or more blocking bars, such that when the key is inserted into the cylinder, the inner portions of the rotors align to magnet positions, resulting in the outer portions of the rotors aligning to the slots.

13. The apparatus of claim 12, wherein the shaft and the interior recess are cylindrical, and the magnets are disposed around and along the shaft.

14. The apparatus of claim 12, wherein the shaft comprises groups of recesses at positions in the shaft corresponding to rotor positions, the magnets secured in the groups of recesses with bonding material such that a group of recesses comprises one recess holding a magnet and other recesses filled with the bonding material.

15. The apparatus of claim 14, wherein a group of recesses comprises three recesses corresponding to three possible positions of slots in the one or more blocking bars.

16. The apparatus of claim 12, wherein the key further comprises:

a non-magnetic sleeve surrounding the shaft;

a key handle coupled to the shaft, the key handle formed with an opening permitting the sleeve to retract into the opening when the key is in use; and a compression spring disposed in the opening of the key handle to bias the sleeve into a position covering the magnets when the key is not in use.

17. The apparatus of claim 12, wherein the key further comprises a shear pin extending from the shaft, the shear pin shaped to engage a slot in the end opening of the cylinder for transferring torque from the key to the cylinder, wherein the shear pin is weaker than the cylinder, the rotors, and the one or more blocking bars.

18. A system comprising:

a lock, comprising:

a cylinder disposed in a housing, the cylinder formed with an end opening and a plurality of side openings, the end opening communicating with an interior recess;

a plurality of rotors disposed in the side openings and pivotably coupled to the cylinder, the rotors comprising inner portions that extend from pivot points toward the interior recess, and outer portions that extend from the pivot points past an outer surface of the cylinder; and one or more blocking bars affixed to the housing, the one or more blocking bars formed with a plurality of slots and disposed such that rotation of the cylinder is permitted when the rotors are aligned with the slots and limited when at least one rotor is non-aligned with a slot; and one or more keys, wherein a key comprises:

a non-magnetic shaft; and a plurality of magnets positioned in the shaft based on positions of the slots in the one or more blocking bars of the lock, such that inserting the key into the lock aligns the rotors to the slots.

19. The system of claim 18, wherein the shaft is cylindrical, the magnets are disposed around and along the shaft, and the key further comprises a shear pin extending from the shaft for transferring torque from the key to the lock.

20. A method comprising:

providing a cylinder disposed in a housing, the cylinder formed with an end opening and a plurality of side openings, the end opening communicating with an interior recess;

providing a plurality of rotors disposed in the side openings and pivotably coupled to the cylinder, the rotors comprising inner portions that extend from pivot points toward the interior recess, and outer portions that extend from the pivot points past an outer surface of the cylinder;

forming a plurality of slots and a plurality of blind openings in one or more blocking bars;

affixing the blocking bars to the housing such that rotation of the cylinder is permitted when the rotors are aligned with the slots and limited when at least one rotor is non-aligned with a slot;

providing a key with a shaft shaped to be inserted into the interior recess; and disposing magnets at positions in the shaft based on positions of the slots in the one or more blocking bars, such that when the key is inserted into the cylinder, the inner portions of the rotors align to magnet positions, resulting in the outer portions of the rotors aligning to the slots.

* * * * *